US007207382B2

(12) United States Patent
Schaeper

(10) Patent No.: US 7,207,382 B2
(45) Date of Patent: Apr. 24, 2007

(54) SHEARING SEALING RAM

(76) Inventor: Gary R. Schaeper, 23418 Cannon Creek Trail, Tomball, TX (US) 77377

( * ) Notice: Subject to any disclaimer, the term of this patent is extended or adjusted under 35 U.S.C. 154(b) by 0 days.

(21) Appl. No.: 11/189,165

(22) Filed: Jul. 26, 2005

(65) Prior Publication Data

US 2006/0021749 A1 Feb. 2, 2006

Related U.S. Application Data

(60) Provisional application No. 60/591,451, filed on Jul. 27, 2004.

(51) Int. Cl.
*E21B 29/08* (2006.01)
*E21B 33/06* (2006.01)

(52) U.S. Cl. ..... 166/55; 166/85.4; 251/1.1; 251/1.3

(58) Field of Classification Search ..... 166/55, 166/85.4; 251/1.1–1.3
See application file for complete search history.

(56) References Cited

U.S. PATENT DOCUMENTS 3,561,526 A * 2/1971 Williams et al. ..... 166/55
3,946,806 A 3/1976 Meynier
4,132,265 A 1/1979 Williams
4,132,266 A 1/1979 Randall
4,313,496 A 2/1982 Childs et al.
4,341,264 A 7/1982 Cox et al.
4,347,898 A 9/1982 Jones
4,646,825 A * 3/1987 Van Winkle ..... 166/55

OTHER PUBLICATIONS

Cameron, Shear Ram Product Line, pp. 1, 3, and 5.

* cited by examiner

*Primary Examiner*—Jennifer H. Gay
*Assistant Examiner*—Giovanna M Collins
(74) *Attorney, Agent, or Firm*—Locke Liddell & Sapp LLP

(57) ABSTRACT

The present invention provides a method, apparatus, and system to shear a tubular member disposed in a well and seal the wellbore using a unique blade seal. In at least one embodiment, the blade seal is adapted to interface with opposing rams in a blowout preventer. The blade seal uses a combination of arcuate surfaces with a common center-point to interface with corresponding surfaces in a ram block of a ram. The blade seal retains sealing capabilities used for wells and at the same time reduces the forces on the ram body to reduce failures from overpressurization. Further, the blade seal can be used in existing blowout preventers bodies that heretofore have been overstressed by prior art designs.

20 Claims, 7 Drawing Sheets

SHEARING SEALING RAM

This application claims the benefit of U.S. Provisional Application No. 60/591,451, filed Jul. 27, 2004.

FIELD OF THE INVENTION

The present invention relates to oil and gas field equipment. More specifically, the invention relates to well control equipment.

BACKGROUND OF THE INVENTION

In gas and oil wells, it is sometimes necessary to shear a tubular member disposed therein and seal the wellbore to prevent an explosion or other mishap from subsurface pressures. Typically, the oil field equipment performing such a function is known as a "blowout preventer." One example, incorporated by reference herein, is U.S. Pat. No. 3,946,806 to Meynier. In FIGS. 1 and 2, a preventer 10 has a body 11 with a longitudinal bore 12 through which a drill pipe 15 can extend. A pair of rams 13A, 13B, extending laterally from opposite sides of the bore, are able to move axially within guideways 14 and lateral to the bore. A pair of operators 16 connected to the body at the outer ends of the rams cause the rams to move laterally and shear the drill pipe disposed therebetween with shear blades 19A, 19B. The ram shear blades are at slightly different elevations so that shear blade 19A passes slightly below shear blade 19B to effect the shearing action.

Because pressure inside the drill pipe is released upon shearing, various seals surround the rams. Seals 29A/B seal on the top of the rams that is downstream of the subsurface pressure from the ram body, side seals 25A/B, 26A/B seal on the sides of the rams, seals 37A/B seals at the rear of the blades 19A/B, and seal member 42 seals between adjacent surfaces of the blades after the shearing action. This original design effected a large change in the industry to shear using V-shaped blades. The V-shaped blades reduce an initial force required to shear the drill pipe by shearing an outer periphery first and then progressing through the remaining cross section of the pipe. However, this design proved insufficient due to leakage around the seals and particular around the seal member 42 between the adjacent blade surfaces. The seal member 42 was fitted to a fixed width slot 43 in the ram that did not axially compress the seal member 42 when the blades passed each other.

Small, but important improvements thereafter characterized the industry. A few years later, an apparent improvement over the Meynier sealing problem was disclosed in U.S. Pat. No. 4,132,265 to Williams and U.S. Pat. No. 4,132,266 to Randall. Williams and Randall teach a ram with only one V-shear blade projecting toward an opposing ram with a rectangular-face shear blade. For example, in Randall, a face seal 40 is mounted in a recess in the ram 24 so that the rectangular-face shear blade 38 after the shearing can compress in an axially direction the face seal 40. Due to other assembly issues, the face seal 40 is designed to be inserted from the side into position in a similarly shaped groove formed in the ram 24 (not shown, but used in commercial practice) to hold the face seal in position. The face seal could be compressed into a positive sealing position against the rear surfaces of the recess. The improvement converted the inadequate sliding contact of the seal member 42 of Maynier to an axially compressive sealing contact between the flat-face shear blade 38 with the flat-face seal 40. The improved contact was caused by the shear blade 38 axially compressing the face seal through contact with the blade end. Williams and Randall were able to seal higher pressures with the new design. However, Williams and Randall did not teach sealing with the V-shaped blade for the sealing contact because of the manner in which the face seal is installed from a side of the ram into position. While providing an improved seal, Williams' and Randall's design tradeoff was to abandon the V-shaped blade, resulting in an increased shearing force from using the flat-face blade instead of a V-shaped blade.

Subsequent developments moved the industry back to the double V-shaped blades with rams, but remained problematic. The flat-face blade and seal of Williams and Randall was replaced by a V-shaped blade and seal to improve the cutting of the tube. A flat rear portion of the seal was used to fit into a corresponding slot in the ram, but the seal also included a front V-shaped extension that was engageable by the V-shaped blade. The design allowed the desirable axial compression of the seal by the V-shaped blade, but led to a different problem. The additional surface area of the V-shaped seal at a given pressure with the flat base created additional forces on the blowout preventer bodies and consequent failures. The design could only be safely inserted into certain sizes of standard blowout preventers. For example, if a standard blowout preventer product line included ten standard sizes for drill pipe, only perhaps two sizes of the standard configurations were capable of the increased stress levels. While redesigned blowout preventers bodies could be made for the additional stress, the industry was adverse to new designs. Commercially, it was unacceptable to create incompatible bodies that would require the replacement of the thousands and thousands of existing bodies to use the design. For the other sizes that were unable to use the seals causing higher stresses, a variation was created that accommodated a V-shaped blade, but did not axially compress the seal. The stresses were accommodated, but the sealing was relegated to the prior art sealing designs that had proven less than desirable for the well pressures. Thus, the options were limited to either the very few sizes that could accommodate the additional stress or the less than desirable sealing by the absence of axial compression of the blade seal.

These two options have dominated the industry for approximately two decades. Despite the great needs and recognized focus, no design has produced a satisfactory solution that could combine the V-shaped blade with axial compression throughout most, if not all, of the standard blowout preventer bodies.

Therefore, there remains a need for improved sealing in a blowout preventer and similar equipment that shear and seal a tubular good used in a wellbore.

SUMMARY OF THE INVENTION

The present invention provides a method, apparatus, and system to shear a tubular member disposed in a well and seal the wellbore using a unique blade seal. In at least one embodiment, the blade seal is adapted to interface with opposing rams in a blowout preventer. The blade seal uses a combination of arcuate surfaces with a common centerpoint to interface with corresponding surfaces in a ram block of a ram. The blade seal retains sealing capabilities used for wells and at the same time reduces the forces on the ram body to reduce failures from overpressurization. Further, the blade seal can be used in existing blowout preventers bodies that heretofore have been overstressed by prior art designs.

BRIEF DESCRIPTION OF THE DRAWINGS

A more particular description of the invention, briefly summarized above, may be had by reference to the embodiments thereof that are illustrated in the appended drawings and described herein. It is to be noted, however, that the appended drawings illustrate only some embodiments of the invention and are therefore not to be considered limiting of its scope, because the invention may admit to other equally effective embodiments.

DETAILED DESCRIPTION OF A PREFERRED EMBODIMENT

Figure 1:
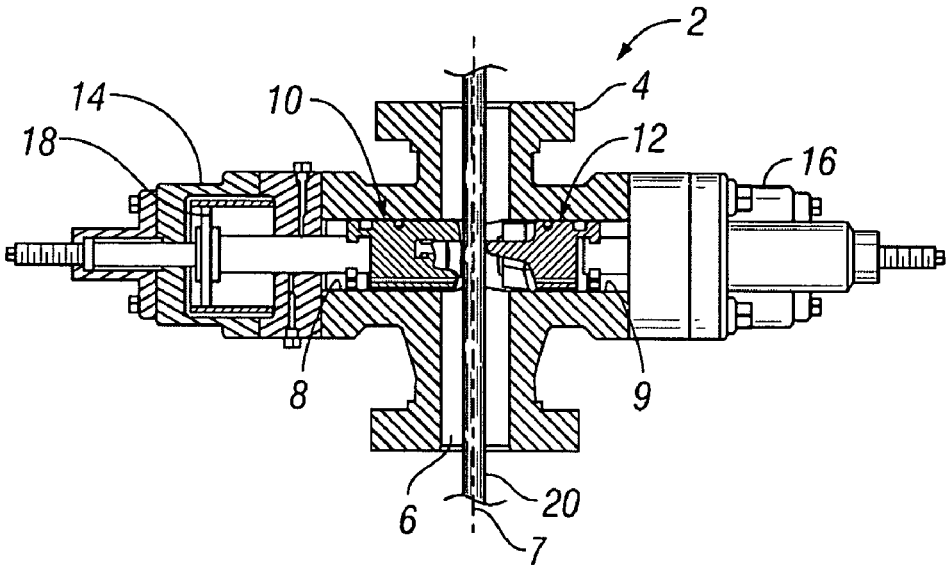
FIG. 1 is a cross-sectional schematic view of a blowout preventer having one or more sealing rams disposed therein.

FIG. 1 is a cross-sectional schematic view of a blowout preventer having one or more sealing rams disposed therein. Blowout preventer 2 includes a blowout preventer body having an opening 6 formed therethrough. The opening 6 is sized sufficiently to allow a tubular member 20 to be placed in position through the opening 6. While the orientations will be described in terms of "lower," "upper," "left," "right," and other directions, it is to be understood that such directions are for the benefit of the reader in reference to the position of the drawings. In actual practice, the orientation can vary and such varying orientations are within the scope of the invention.

The blowout preventer 2 further includes a first ram 10 disposed laterally to the opening 6. The ram 10 can move laterally left and right in the view of the FIG. 1 and is guided by a first guideway 8. The first guideway 8 is disposed at an angle to a centerline 7 of the opening 6, generally at a right angle. Similarly, a second ram 12 is disposed in a second guideway 9 at an angle to the centerline 7 of the opening 6. The first ram 10 is actuated by a first actuator 14. The first actuator 14 can be electrically, hydraulically, pneumatically, or otherwise operated. In the example shown, a piston 18 is displaced by incoming pressurized fluid to move the first ram 10 toward the centerline 7 to engage and generally sever the tubular member 20 disposed therein. Similarly, the second ram 12 can be actuated by a second actuator 16 to move the second ram 12 toward the centerline 7 to assist in severing the tubular member 20 in conjunction with the first ram 10.

Figure 2:
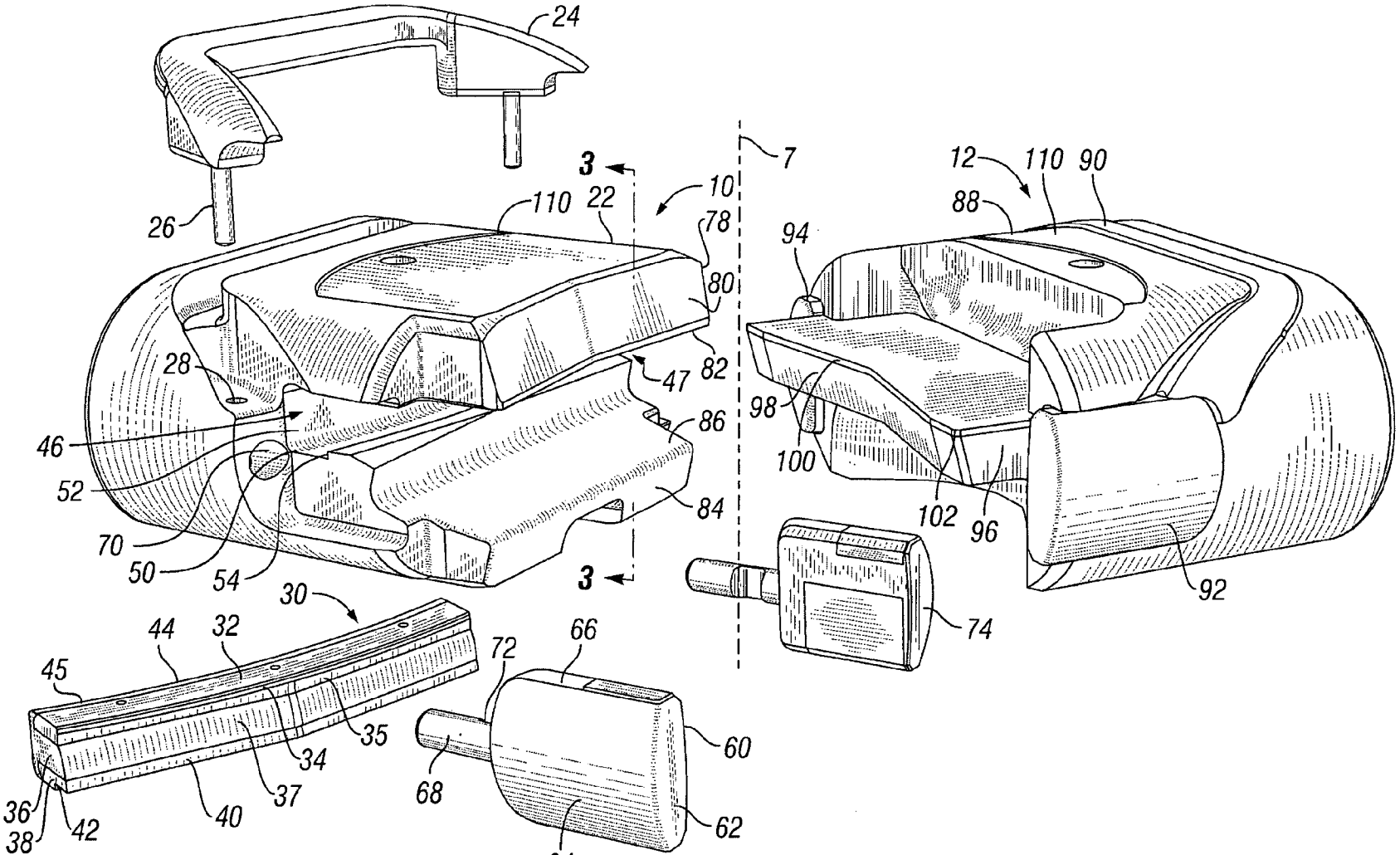
FIG. 2 is an assembly view of a pair of rams with various seals.
Figure 3A:
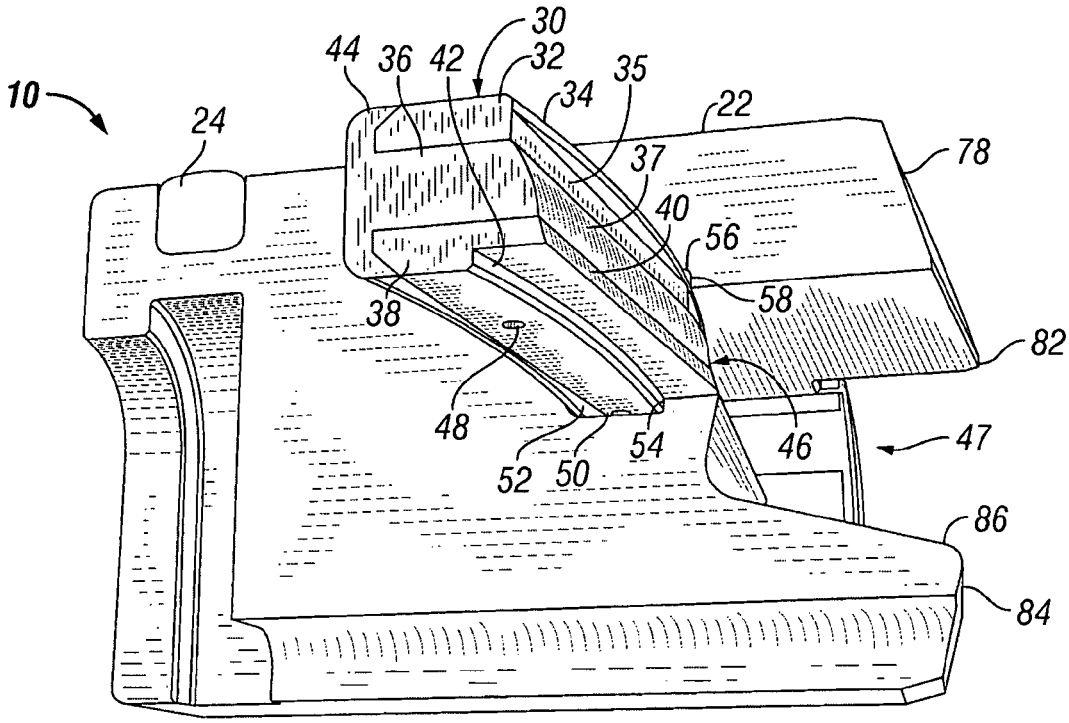
FIG. 3A is an upper perspective cross-sectional schematic view through a vertical portion of the first sealing ram with a blade seal disposed therein.
Figure 3B:
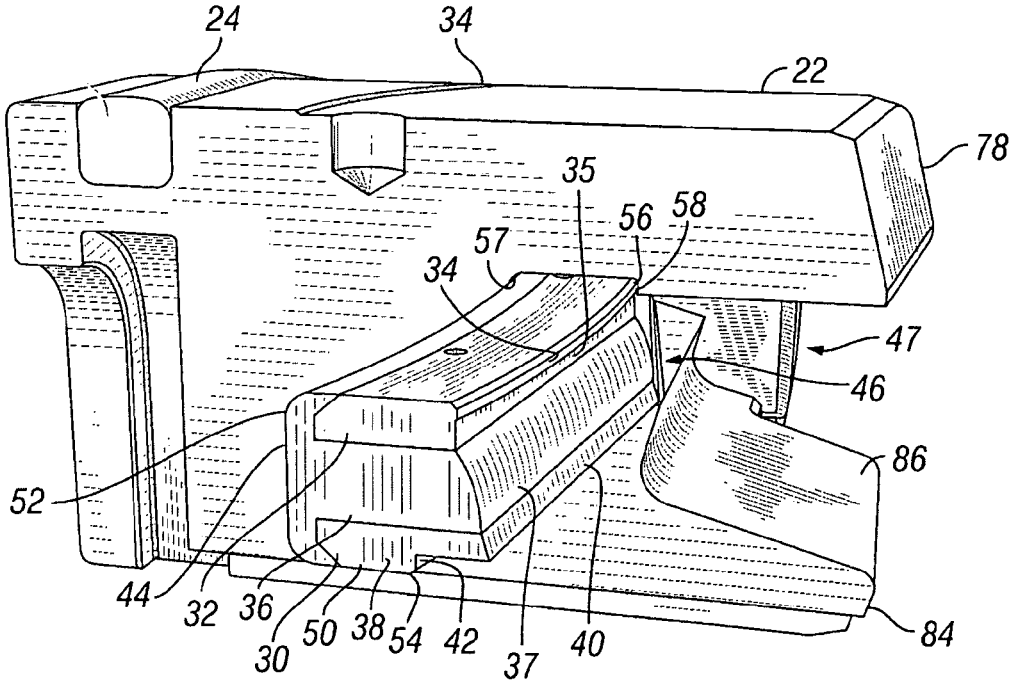
FIG. 3B is a lower perspective cross-sectional schematic view through a vertical portion of the first sealing ram with a blade seal disposed therein.

FIG. 2 is an assembly view of a pair of rams with various seals. FIG. 3A is an upper perspective cross-sectional schematic view through a vertical portion of the first sealing ram with a blade seal disposed therein. FIG. 3B is a lower perspective cross-sectional schematic view through a vertical portion of the first sealing ram with a blade seal disposed therein. The drawings will be described in conjunction with each other given the similarity and overlap of the different perspectives and views.

The first ram 20 generally includes a first ram block 22 and a variety of seals and shaped forms for shearing the tubular member disposed in the blowout preventer and sealing a well after the shearing. The first ram further includes a lateral seal 24 that generally seals on a downstream pressure side 110 of the ram where the downstream side is the side distal from a pressurized tubular member that is severed. The seal 24 is sometimes referred to as the "top seal" because, in general, a severed tubular member will have pressure from below the blowout preventer caused by subsurface pressures. The lateral seal 24 can be coupled to the ram block 22 by use of a coupler 26. In at least one embodiment, the coupler 26 can be a pin that is used to engage an opening 28 formed in the ram block for ready insertion therein. The term "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally.

The ram 10 further includes a unique blade seal 30 inserted in the first ram block 22, described in more detail below. The blade seal 30 is secured to the first ram block 22 in a blade seal support 46 of the first ram block. The blade seal support 46 is formed or otherwise coupled with the first ram block 22 in a recessed portion 47 of the ram block. The recessed portion 47 is generally disposed vertically between a first ram block cutter extension 78 that extends toward the centerline 7 and an extension forming surface 86 that also extends toward the centerline 7. In some embodiments, the first ram block cutter extension 78 includes a forward V-shaped extension front surface 80. Further, the cutter extension 78 includes a first blade 82, which generally conforms to the shape of the V-shaped extension front surface 80. The shape of the blade can vary, although historically, it has been shown that a V-shaped blade has a high degree of efficiency in shearing the tubular member disposed therein. The first ram block bending extension 84 is used to capture a portion of the tubular member disposed therein as the first ram 10 engages the tubular member and to provide an extension forming surface 86 on which a portion of the severed tubular member is bent.

Referring particularly to the unique blade seal 30, the blade seal can include a combination of one or more arcuate surfaces and V-shaped surfaces in combination with a shaped sealing element. In at least one embodiment, the blade seal can include an upper retainer 32, a blade sealing element 36, and a lower retainer 38. In other embodiment, the blade seal can include one retainer. Still further, the sealing element 36 and one or more of the retainers 32, 38 can be integrally formed together as one piece. The blade sealing element is sized and shaped to provide a sealing surface after actuation of the blowout preventer when the first and second rams converge toward each other and sever the tubular member disposed therebetween. The blade seal 30 provides a means of sealing blowout preventer from leakage downstream of the pressure side of the severed member.

In at least one embodiment, the upper retainer 32 can include an upper retainer front arcuate surface 34, where the term "front" is generally the direction closer to the centerline 7, shown in FIG. 1, and "rear" is generally the direction away from the centerline 7. The upper retainer front arcuate surface 34 can be sized to engage a groove disposed in the ram block 22, described below. Further, the first retainer 32 can include an upper retainer rear arcuate surface 45. The blade sealing element 36 can extend toward the rear of and beyond the upper retainer rear arcuate surface 45. Further, in general, the sealing element 36 can be formed with a sealing element rear arcuate surface 44 that is adjacent the upper retainer rear arcuate surface 45 of the first retainer 32. The sealing element 36 further includes a sealing element front surface 37. The sealing element front surface 37 is generally V-shaped to correspond to a V-shaped blade in the second ram 12.

Advantageously, the inventor has discovered that the arcuate shape can unexpectedly provide sufficient sealing capabilities for the sealing pressures needed, but reduce the surface area compared to prior art designs described in the background to lessen the forces on the ram block 22. Thus, the disadvantages of the prior art that increases the surface area to provide better sealing but result in greater forces that cause failure on the blowout preventer bodies are resolved by the present invention. Further, the design of the blade seal 30 can allow the blade seals to be used in many of the commonly sized blowout preventers and ram sizes that heretofore have excluded by those with ordinary skill in the art.

The upper retainer front arcuate surface 34 has a radius with a centerpoint. To allow lateral insertion into the ram block 22 as described herein, in general, the sealing element rear arcuate surface 44, having a different radius, will still converge at the same centerpoint. Thus, the centerpoint is common to both arcuate surfaces. Further, in some embodiments, the upper retainer rear arcuate surface 45 of the first retainer 32 can also have a common centerpoint, although that surface can vary, because the sealing element rear arcuate surface 44 is generally the surface that actually contacts the first ram block 22 in conformity therewith.

The blade seal 30 can further include an upper retainer blade surface 35 in proximity to the upper retainer front arcuate surface 34. The upper retainer blade surface 35 will generally conform to the shape of the blade in the second ram 12. In at least one embodiment, the upper retainer front arcuate surface 34 can have an equal to or greater radius than a radius of an arc that circumscribes the endpoints and forward point of the V-shaped upper retainer blade surface 35, shown in FIG. 4A.

The blade seal 30 can further include a lower retainer 38. The lower retainer 38 can similarly include a lower retainer front arcuate surface 42 having a radius with a centerpoint. In general, the centerpoint of the lower retainer front arcuate surface 42 will be common to the centerpoint of the upper retainer front arcuate surface 34, even though they can have different radii. If a lower retainer 38 is used, then, in general, the sealing element 36 will be at least partially disposed between the upper and lower retainers.

Having described the arcuate sealing element, it is to be understood that the unique shape with the arcuate surfaces allows the blade seal to be laterally slid into position for ready assembly while still retaining and supporting the blade seal in a position for later engagement with the V-shaped blade in the second ram. It is also to be understood, given the disclosure contained herein, that the arcuate surfaces allow the blade seal to be installed in an arc into the ram block 22 and yet be supported in close conformity to the size of the upper and/or lower retainer for secure attachment therein.

As described above, the blade seal 30 is generally disposed in the blade seal support 46 of the first ram block 22. The blade seal support 46 can include a lower arcuate groove 50 having a lower arcuate front retainer stop 54 formed in a frontal edge of the groove and a lower arcuate rear retainer stop 52 formed in a rearward edge of the groove. The lower arcuate front retainer stop 54 has a radius with a centerpoint and the lower arcuate rear retainer stop 52 has a different radius but with a centerpoint common to the stop 54.

In at least one embodiment, the lower retainer front arcuate surface 42 of the blade seal 30 is sized to be placed adjacent the lower arcuate front retainer stop 54 when the blade seal is assembled into position in the first ram block 22. Similarly, the sealing element rear arcuate surface 44 of the blade seal 30 is sized to be disposed adjacent the lower arcuate rear retainer stop 52 when the seal is placed into position. In at least one embodiment, the lower retainer 38 with its lower retainer front arcuate surface 42 is disposed in a plane different than the lower retainer blade surface 40. Thus, the lower retainer 38 can be used to fit into the lower arcuate groove 50 formed in the blade seal support 46 of the first ram block 22. It is to be understood that the elements can be switched so that the groove could be formed into the blade seal 30 and the protruding retainer surface could be formed in the blade seal support 46. Other combinations are possible to secure the blade seal with the ram block in an arcuate manner. In at least one embodiment, the lower retainer front arcuate surface 42 and sealing element rear arcuate surface 44 can have a common centerpoint with the centerpoint of the lower arcuate front retainer stop 54 and the lower arcuate rear retainer stop 52. The tolerance of the convergence of centerpoints depends on normal manufacturing processes suitable to allow engagement of the blade seal 30 with the retainer stop or stops in the ram block and upon the relative dimensions and fit.

In a similar way, the blade seal support 46 can include an upper arcuate groove 56 to support the upper retainer 32 of the blade seal 30. For example, the blade seal support 46 can include an upper arcuate front retainer stop 58 shown more clearly in FIGS. 3A–3B, where the upper arcuate front retainer stop 58 is sized to support the upper retainer front arcuate surface 34 of the blade seal 30 when the blade seal is in position. Similarly, the upper arcuate groove 56 can include an upper arcuate rear retainer stop 57 to support the rear of the blade seal 30 such as at the sealing element rear arcuate surface 44. In some embodiments, the lower arcuate rear retainer stop 52 is the same surface with the same radius as the upper arcuate rear retainer stop 57. In at least one embodiment, the upper retainer front arcuate surface 34 and sealing element rear arcuate surface 44 can have a common centerpoint with the centerpoint of the upper arcuate front retainer stop 58 and the upper arcuate rear retainer stop 57. Further, the arcuate surfaces for the lower retainer and associated stops can have a common centerpoint with the arcuate surfaces for the upper retainer and associated stops.

The ram 20 can further include one or more side seals 60, 74. Generally, the side seals will include a front sealing surface 62, an outer sealing surface 64, and an inner sealing surface 66. The side seals can be coupled to the first ram block 22 by a coupler 68, such as a pin. The coupler 68 can be sized for insertion into an opening 70 formed in the first ram block 22. For ease of assembly, a notch 72 can be formed along the length of the coupler 68 so that when the side seals are inserted into the opening 70, then the lateral seal 24 with its coupler 26 can be inserted transversely and engage the notch 72 so that the side seals remain in position.

In a complementary fashion, the second ram 12 includes a second ram block 88. The second ram block 88 generally includes a similar lateral seal 90 and one or more side seals 92, 94. The side seals 92, 94, and side seals 60, 74 are sized lengthwise such that when the first and second rams have severed the pipe and the second ram has contacted the blade seal 30, the front sealing surface 62 of each of the side seals engage each other to reduce a lateral escape of pressure.

The second ram block 88 further includes a second ram block cutter extension 96. In at least one embodiment, the second ram block cutter extension is disposed in a plane, such as in a lower plane relative to the first ram block cutter extension 78 of the first ram block 22. Further, the second ram block cutter extension 96 includes a second blade 100, generally having a V-shaped leading edge. In at least one embodiment, the second ram block cutter extension 96 includes an extension front surface 98 that is formed into a V-shape, as has been described above. The plane is at a lower plane so that as the second blade 100 and the first blade 82 sever the tubular member disposed therebetween, the blades can pass each other without interference. As described above, generally, the second blade 100 will have a shape conforming to the shape of the blade sealing element 36 and, particularly, the sealing element front surface 37. Generally, history has shown that a V-shaped cross-section is advantageous. In some embodiments, the cutter extensions 78, 96 can include an edge chamfer 102. For purposes of the present disclosure, a chamfer can include a rounded or angled edge. The chamfer assists in mitigating cutting of the side seal as the first and second rams shear the tubular member disposed therein.

Figure 4:
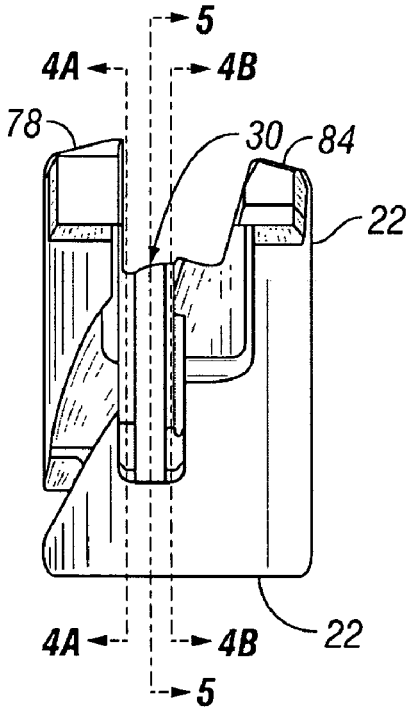
FIG. 4 is a side view of the first ram with the arcuate blade seal disposed therein.
Figure 4B:
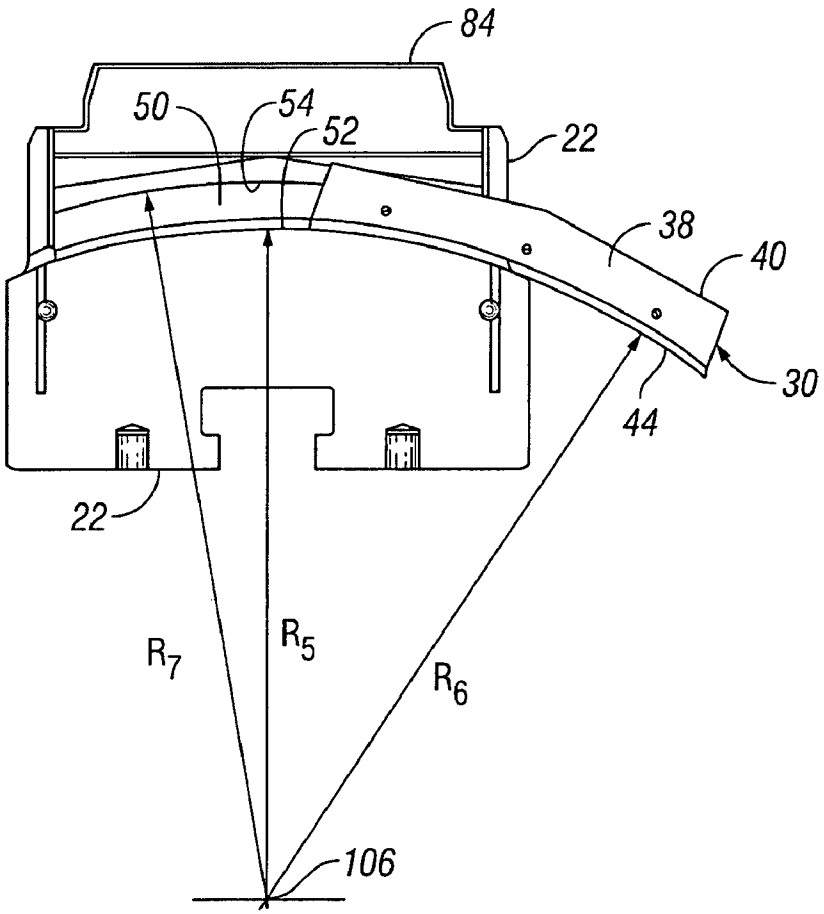
FIG. 4B is a lower lateral cross-sectional view of the ram of FIG. 4 in the direction of the lower bending extension.
Figure 4A:
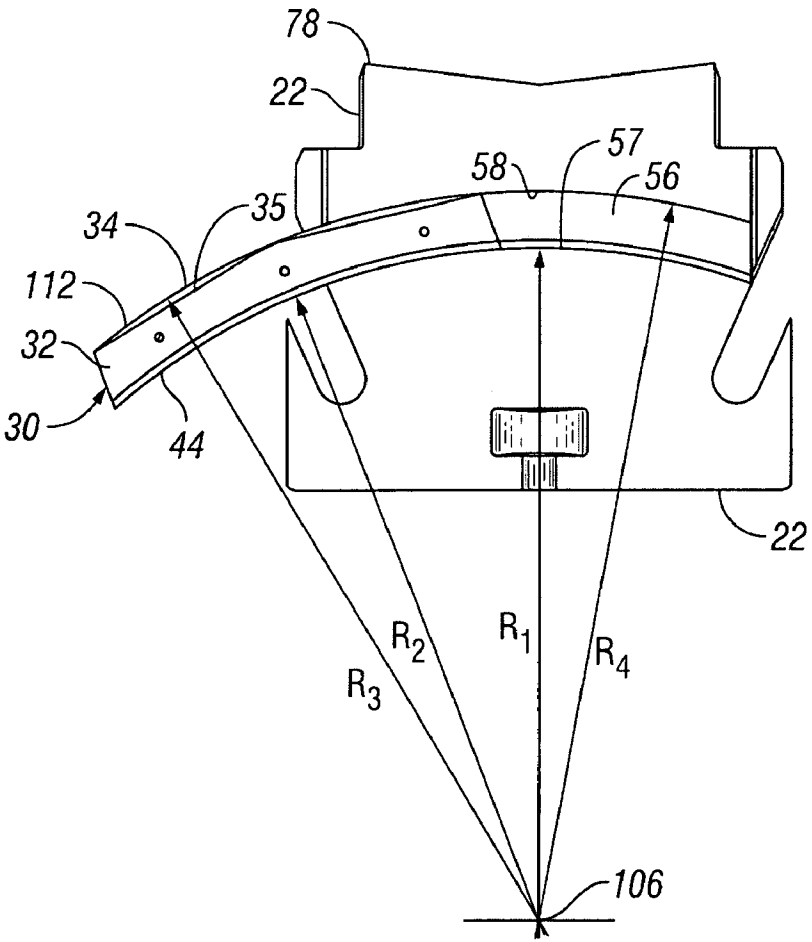
FIG. 4A is an upper lateral cross-sectional view of the ram of FIG. 4 in the direction of the upper cutter extension.

FIG. 4 is a side view of the first ram with the arcuate blade seal disposed therein. FIG. 4A is an upper lateral cross-sectional view of the ram of FIG. 4 in the direction of the upper cutter extension. FIG. 4B is a lower lateral cross-sectional view of the ram of FIG. 4 in the direction of the lower bending extension. FIGS. 4, 4A, and 4B will be described in conjunction with each other.

The blade seal 30 is disposed at least partially engaged with the upper arcuate groove 56. As shown, the upper arcuate rear retainer stop 57 has a first radius R1 that converges at a centerpoint 106 of the arcs. In at least one embodiment, the blade sealing element 36 extends rearward of the upper retainer 32 and has a sealing element rear arcuate surface 44. The sealing element rear arcuate surface 44 has a radius R2 that is about equal to or greater than the radius R1, so that the upper retainer 32 and portion of the blade sealing element 36 can fit into the upper arcuate groove 56. Similarly, the upper arcuate front retainer stop 58 has a radius R4 that is generally equal to or greater than a radius R3 of the upper retainer front arcuate surface 34 on the upper retainer 32. In general, the upper retainer front arcuate surface 34 will have an equal to or greater radius than an arc 112 that circumscribes the end points and forward extension of the V-shaped upper retainer blade surface 35. The various radii generally have a common centerpoint.

FIG. 4B similarly illustrates the cooperation between the first ram block 22 and the blade seal 30 on a lower retainer. The lower arcuate groove 50 can be formed in the first ram block 22 to support the lower retainer 38 of the blade seal 30. In at least one embodiment, the lower arcuate rear retainer stop 52 has a radius R5 and the sealing element rear arcuate surface 44 has a radius R6. In general, the radius R5 will be equal to or less than the radius R6 to allow the sealing element arcuate rear surface 44 to be laterally placed in position along the arc formed by the lower arcuate rear retainer stop 52. In general, the radius R6 of FIG. 4B will be equal to the radius R2 of FIG. 4A. Similarly, the lower arcuate front retainer stop 54 has a radius R7 that is generally equal to or greater than a radius of the lower retainer front arcuate surface 42, shown in FIG. 3B. The various radii generally have a common centerpoint. In at least one embodiment, the lower retainer blade surface 40 will extend beyond the lower arcuate front retainer stop 54 in an overlapping fashion yet still retain the retainer 38 by supporting the lower retainer front arcuate surface 42 of the lower retainer 38, as shown in FIG. 3B.

Figure 5:
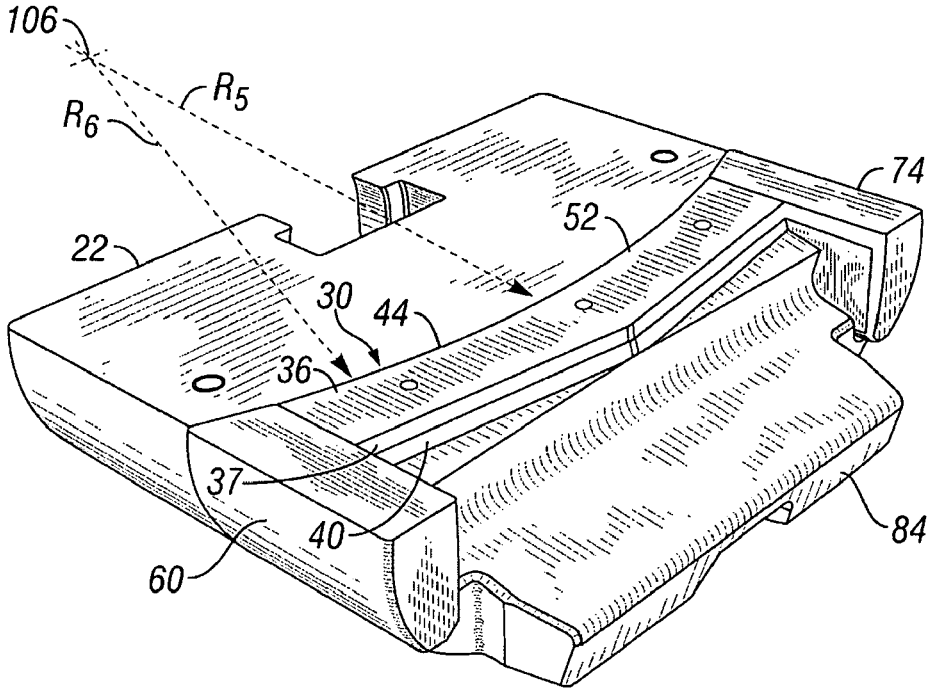
FIG. 5 is a lateral cross-sectional view of a lower portion of the first ram with the blade seal and a pair of side seals installed therein.

FIG. 5 is a lateral cross-sectional view of a lower portion of the first ram with the blade seal and a pair of side seals installed therein. FIG. 5 illustrates the arrangement of the blade seal 30 and side seals 60, 74 when placed in position with the first ram block 22. The ram block 22 includes the lower arcuate rear retainer stop 52 having a radius R5. The sealing element 36 of the blade seal 30 has a rear arcuate surface 44 with a radius R6. The radius R6 will generally be equal to or greater than the radius R5. The front of the blade seal 30 can include the lower retainer blade surface 40, generally V-shaped. Similarly, the sealing element front surface 37 of the blade sealing element 36 can have a shape corresponding to the lower retainer blade surface 40. Each of those elements can have a corresponding shape to the blade 100 of the second ram block 88, described above.

Figure 6:
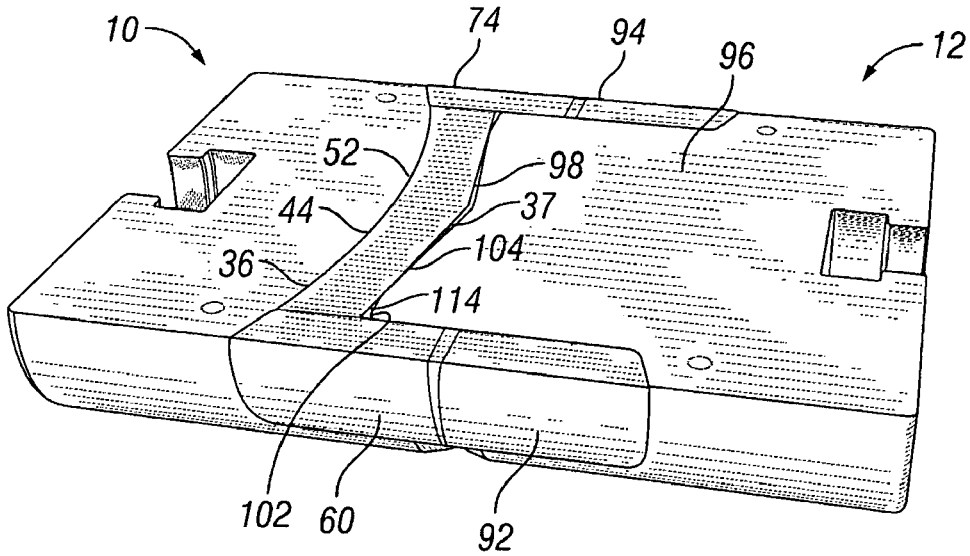
FIG. 6 is a lateral cross-sectional view of a first ram with a blade seal and pair of side seals engaged with a second ram with a pair of side seals, generally after a tubular member has been sheared.

FIG. 6 is a lateral cross-sectional view of a first ram with a blade seal and pair of side seals engaged with a second ram with a pair of side seals, generally after a tubular member has been sheared. After the tubular member described above is severed, the interaction between the first ram 10 and the second ram 12 allows the second ram block cutter extension 96 to enter the recessed portion 47 of the first ram block 22, as shown in FIGS. 2, 3B. In general, the second ram block cutter extension 96 will extend such that the extension front surface 98 with the blade 100 (shown in FIG. 2) can engage the sealing element 36 along the sealing element front surface 37. Further, such engagement can allow the side seals to engage each other along each side of the ram blocks. For example, the side seal 60 of the first ram can engage the corresponding side seal 92 of the second ram so that their front faces effect a sideways seal of the ram. Similarly, the side seal 74 of the first ram 10 can engage the side seal 94 of the second ram 12. As shown in FIG. 6, the angle of the "V" in the extension front surface 98 may not exactly correspond to the angle of the "V" in the sealing element front surface 37. For example, it can be advantageous to "pinch" the outside portions of the sealing element front surface 37 with one or more outer contact points 104 of the extension front surface 98, so that further engagement by the front surface 98 compresses the sealing element front surface 37 toward the center of the "V". Further, FIG. 6 illustrates a rearward taper 114 of the extension front surface 98 of the second ram 12 culminating in the outer chamfers 102. Such tapers and chamfers are optional and can help reduce tearing or other effects on the sealing surfaces of the side seals of the first ram 10.

Figure 7:
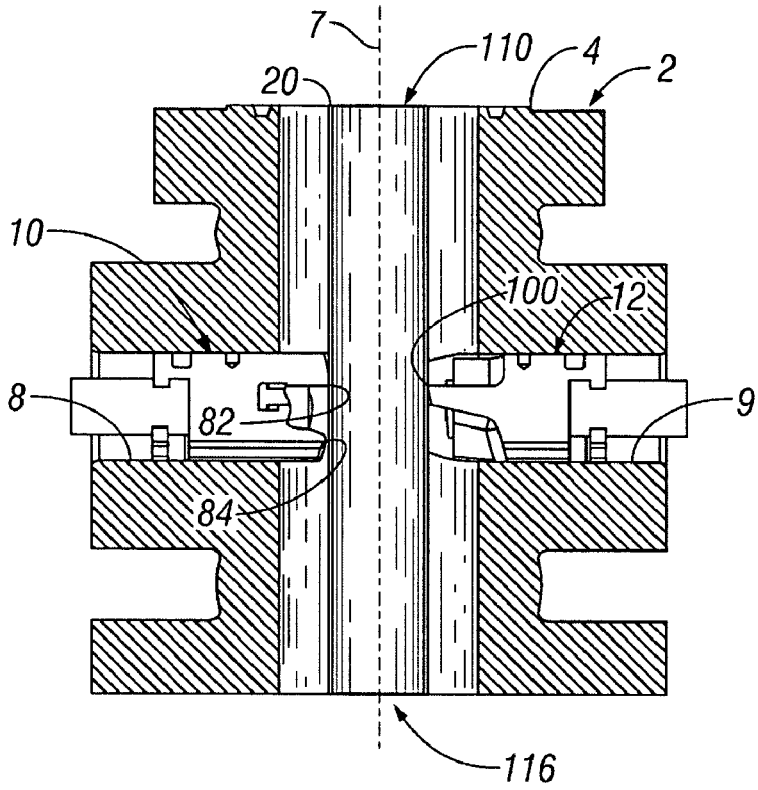
FIG. 7 is a schematic cross-sectional view through a blowout preventer having a tubular member disposed therein with the first and second rams disposed in operating position.
Figure 8:
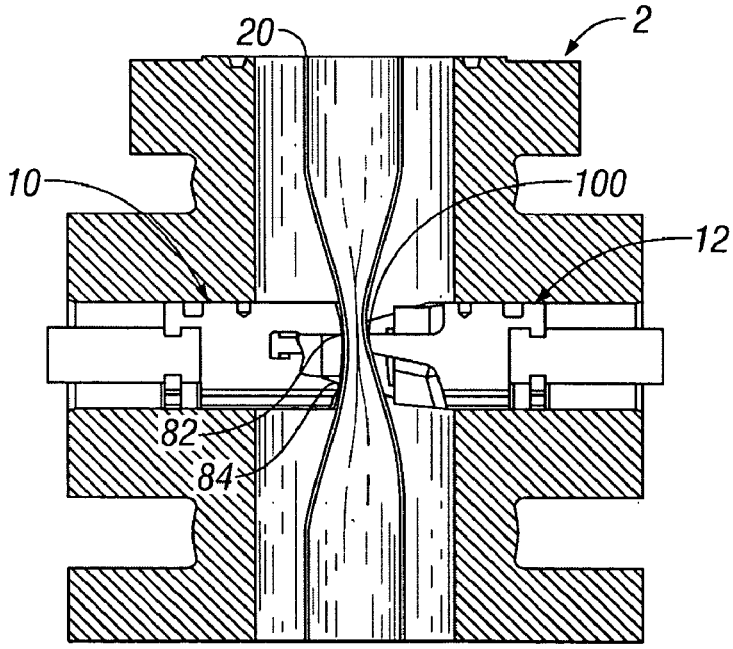
FIG. 8 is a cross-sectional schematic view of FIG. 7 with the first and second rams actuated and displacing the tubular member therebetween.
Figure 9:
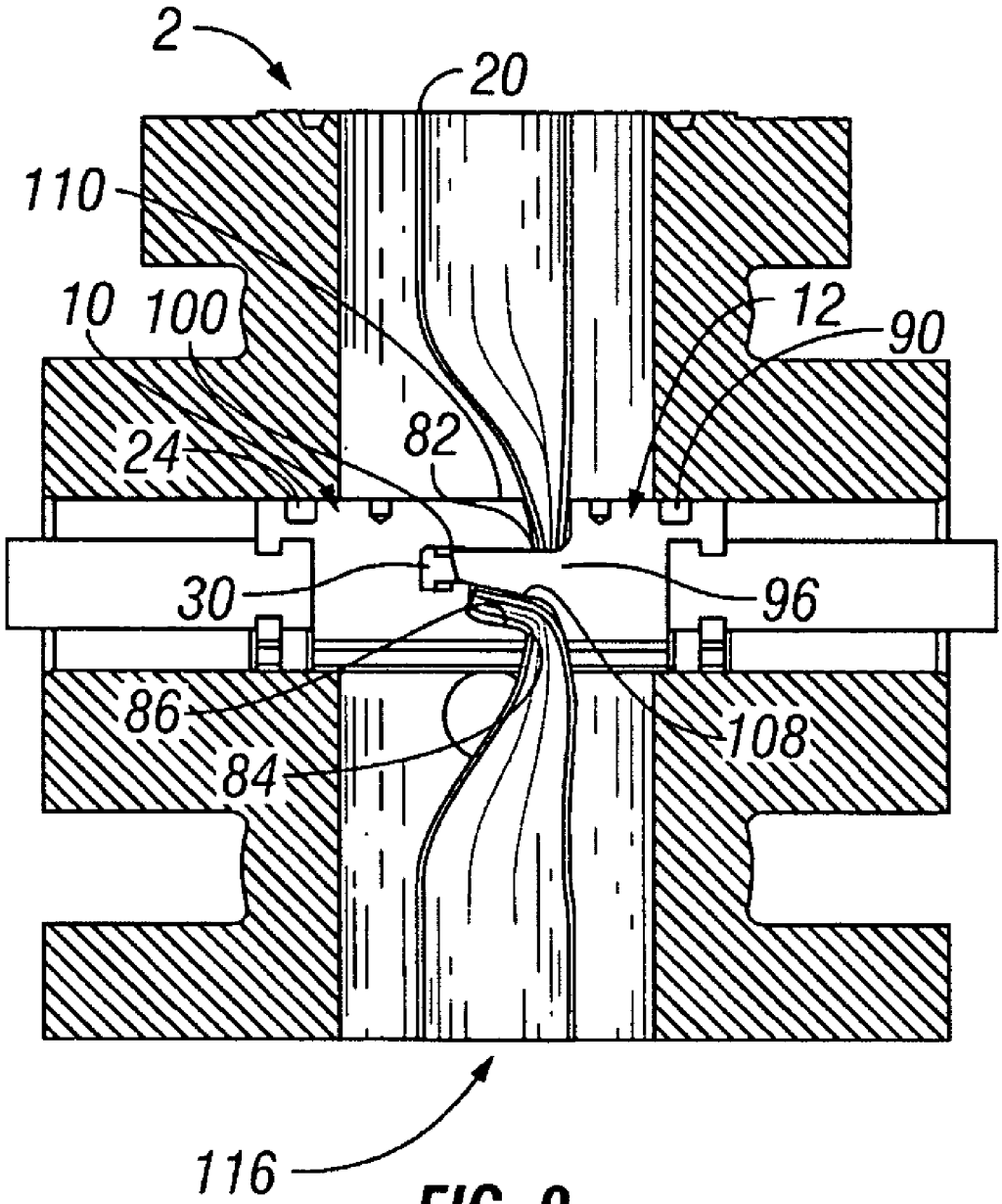
FIG. 9 is a cross-sectional schematic view of the blowout preventer of FIG. 8 with the tubular member sheared and the second ram engaged with the blade seal disposed in the first ram to seal pressure on a downstream side of the severed tubular member.

FIG. 7 is a schematic cross-sectional view through a blowout preventer having a tubular member disposed therein with the first and second rams disposed in operating position. FIG. 8 is a cross-sectional schematic view of FIG. 7 with the first and second rams actuated and displacing the tubular member therebetween. FIG. 9 is a cross-sectional schematic view of the blowout preventer of FIG. 8 with the tubular member sheared and the second ram engaged with the blade seal disposed in the first ram to seal pressure on a downstream side of the severed tubular member. FIGS. 7, 8, and 9 will be described in conjunction with each other.

In an operating position, the tubular member 20 is disposed through the opening 6 along the centerline 7. Generally, the rams will be disposed along the guideways 8, 9 in the body 4 of the blowout preventer 2. A first ram 10 is disposed to the side of the tubular member and the guideway 8. The second ram is disposed laterally to the tubular member 20 in the guideway 9. In at least one embodiment, the first blade 82 is disposed closer to the centerline 7 and the tubular member 20 than the first ram block bending extension 84. Further, as illustrated, the first blade 82 is at a different plane than the second blade 100 such that the blades can pass each other upon actuation of the rams. Generally, the orientation of the elements will be such that when the tubular member is severed, the pressure side 116 may remain pressurized but the blowout preventer can prevent or at least reduce pressure from escaping on the downstream pressure side 110.

When the blowout preventer is actuated and the rams are moved toward the tubular member 20, the rams "pinch" or otherwise compress the surfaces of the tubular member. The compression causes the first blade 82 and the first ram block bending extension 84 to compress a portion of the tubular member 20 on one side while the second blade 100 compresses the tubular member on the second side. As shown in FIG. 9, further compression eventually leads to a shearing of the tubular member 20 by the first blade 82 and the second blade 100. The pressure side 116 is sealed from the downstream pressure side 110 by engagement of the second ram 12 with the first ram 10, particularly in conjunction with the blade seal 30. Further, the pressure is restricted from exiting the blowout preventer by the lateral seal 24 on the first ram 10 and the lateral seal 90 on the second ram 12. A portion 108 of the tubular member 20 that is severed is bent around the first ram block bending extension 84. The interaction of the first ram 10 with the second ram 12 allows the tubular member portion 108 to be contained therein by allowing a volume between the lower portion of the second ram block cutter extension 96 and the upper portion of the first ram block bending extension 84 along the extension forming surface 86.

Various basics of the invention have been explained herein. The various techniques and devices disclosed represent a portion of that which those skilled in the art would readily understand from the teachings of this application. Details for the implementation thereof can be added by those with ordinary skill in the art. The accompanying figures may contain additional information not specifically discussed in the text and such information may be textually added without adding new subject matter. Additionally, various combinations and permutations of all elements or applications can be created and presented. All can be done to optimize performance in a specific application.

In at least one embodiment, the lower retainer front arcuate surface 42 and sealing element rear arcuate surface 44 can have a common centerpoint with the centerpoint of the lower arcuate front retainer stop 54 and the lower arcuate rear retainer stop 52. Further, any documents to which reference is made in the application for this patent as well as all references listed in any list of references filed with the application are hereby incorporated by reference. However, to the extent statements might be considered inconsistent with the patenting of this invention such statements are expressly not to be considered as made by the applicant(s).

Also, any directions such as "top," "bottom," "left," "rear," "front," "right," "upper," "lower," and other directions and orientations are described herein for clarity in reference to the figures and are not to be limiting of the actual device or system or use of the device or system. The device or system may be used in a number of directions and orientations.

The invention claimed is:

1. A system for shearing an oil field tubular product, comprising:

a. a blowout preventer body having an opening disposed therethrough for the tubular product;

b. a first ram coupled to the blowout preventer body along a first guideway formed in the body having a guide surface for the first ram disposed at an angle to a centerline of the opening, comprising:

i. a blade seal comprising:

a) a first retainer with a first arcuate surface having a first radius and a centerpoint for the radius;

b) a sealing element coupled to the first retainer;

ii. a first ram block comprising:

a) a V-shaped cutter extension having a first blade extending toward the centerline; and b) the ram block having a blade seal support disposed in a recessed portion of the block away from the centerline relative to the cutter extension and adapted to support the blade seal, the blade seal support having a first arcuate retainer stop, the first arcuate retainer stop having a radius with a centerpoint common to the first arcuate surface centerpoint of the first retainer and adapted to allow engagement with the blade seal;

c. a second ram coupled to the blowout preventer body along a second guideway formed in the body having a guide surface for the second ram disposed at an angle to a centerline of the opening, comprising:

i) a second ram block comprising a V-shaped cutter extension having a second blade extending toward the centerline and disposed in a different plane that the first blade to allow the second blade to pass the first blade during the shearing and contact a sealing element of the blade seal disposed in the first ram afler the shearing;

d. a first actuator coupled to a first ram and adapted to move the first ram toward the centerline; and e. a second actuator coupled to the second ram and adapted to move the second ram toward the centerline, wherein first ram block comprises a second arcuate retainer stop disposed away from the centerline relative to the first arcuate retainer stop, the first and second arcuate retainer stops having a common centerpoint, and wherein the sealing element comprises a sealing element arcuate surface disposed away from the centerline relative to the first retainer and having a common centerpoint with the first arcuate surface of the first retainer, the sealing element arcuate surface sized to engage with the second arcuate retainer stop.

2. The system of claim 1, wherein the first arcuate retainer stop and the second arcuate retainer stop of the blade seal support are formed in a groove in the recessed portion of the first ram block and adapted to receive the blade seal.

3. The system of claim 1, wherein the first retainer comprises a second arcuate surface disposed away from the centerline relative to the first arcuate surface with a centerpoint common to the first arcuate surface, the sealing element being adapted to engage the second arcuate surface.

4. A system for shearing an oil field tubular product, comprising:

a. a blowout preventer body having an opening disposed therethrough for the tubular product;

b. a first ram coupled to the blowout preventer body along a first guideway formed in the body having a guide surface for the first ram disposed at an angle to a centerline of the opening, comprising:

i. a blade seal comprising:

a) a first retainer with a first arcuate surface having a first radius and a centerpoint for the radius;

b) a sealing element coupled to the first retainer;

ii. a first ram block comprising:

a) a V-shaped cutter extension having a first blade extending toward the centerline; and b) the ram block having a blade seal support disposed in a recessed portion of the block away from the centerline relative to the cutter extension and adapted to support the blade seal, the blade seal support having a first arcuate retainer stop, the first arcuate retainer stop having a radius with a centerpoint common to the first arcuate surface centerpoint of the first retainer and adapted to allow engagement with the blade seal;

c. a second ram coupled to the blowout preventer body along a second guideway formed in the body having a guide surface for the second ram disposed at an angle to a centerline of the opening, comprising:

i) a second ram block comprising a V-shaped cutter extension having a second blade extending toward the centerline and disposed in a different plane that the first blade to allow the second blade to pass the first blade during the shearing and contact a sealing element of the blade seal disposed in the first ram afler the shearing;

d. a first actuator coupled to a first ram and adapted to move the first ram toward the centerline; and e. a second actuator coupled to the second ram and adapted to move the second ram toward the centerline, wherein the blade seal further comprises a second retainer having a first arcuate surface with a centerpoint common with the first actuate surface centerpoint of the first retainer, and the sealing element being disposed at least partially between the first retainer and the second retainer.

5. The system of claim 4, wherein the blade seal support comprises a third arcuate retainer stop disposed toward the centerline relative to the sealing element, the third arcuate retainer stop being disposed in a plane different than the first and second retainer stops and having a common centerpoint with the second retainer of the blade seal and adapted to support the second retainer.

6. A system for shearing an oil field tubular product, comprising:

a. a blowout preventer body having an opening disposed therethrough for the tubular product;

b. a first ram coupled to the blowout preventer body along a first guideway formed in the body having a guide surface for the first ram disposed at an angle to a centerline of the opening, comprising:

i. a blade seal comprising:

a) a first retainer with a first arcuate surface having a first radius and a centerpoint for the radius;

b) a sealing element coupled to the first retainer;

ii. a first ram block comprising:

a) a V-shaped cutter extension having a first blade extending toward the centerline; and b) the ram block having a blade seal support disposed in a recessed portion of the block away from the centerline relative to the cutter extension and adapted to support the blade seal, the blade seal support having a first arcuate retainer stop, the first arcuate retainer stop having a radius with a centerpoint common to the first arcuate surface centerpoint of the first retainer and adapted to allow engagement with the blade seal;

c. a second ram coupled to the blowout preventer body along a second guideway formed in the body having a guide surface for the second ram disposed at an angle to a centerline of the opening, comprising:

i) a second ram block comprising a V-shaped cutter extension having a second blade extending toward the centerline and disposed in a different plane that the first blade to allow the second blade to pass the first blade during the shearing and contact a sealing element of the blade seal disposed in the first ram afler the shearing;

d. a first actuator coupled to a first ram and adapted to move the first ram toward the centerline; and e. a second actuator coupled to the second ram and adapted to move the second ram toward the centerline, wherein the first retainer further comprises a V-shaped retainer blade surface disposed at a different plane than the first arcuate surface.

7. The system of claim 6, wherein the V-shaped retainer blade surface circumscribes an arc with an equal to or smaller radius than a radius of the first arcuate surface of the first retainer.

8. A system for shearing an oil field tubular product, comprising:

a. a blowout preventer body having an opening disposed therethrough for the tubular product;

b. a first ram coupled to the blowout preventer body along a first guideway formed in the body having a guide surface for the first ram disposed at an angle to a centerline of the opening, comprising:

i. a blade seal comprising:

a) a first retainer with a first arcuate surface having a first radius and a centerpoint for the radius;

b) a sealing element coupled to the first retainer;

ii. a first ram block comprising:

a) a V-shaped cutter extension having a first blade extending toward the centerline; and b) the ram block having a blade seal support disposed in a recessed portion of the block away from the centerline relative to the cutter extension and adapted to support the blade seal, the blade seal support having a first arcuate retainer stop, the first arcuate retainer stop having a radius with a centerpoint common to the first arcuate surface centerpoint of the first retainer and adapted to allow engagement with the blade seal;

c. a second ram coupled to the blowout preventer body along a second guideway formed in the body having a guide surface for the second ram disposed at an angle to a centerline of the opening, comprising:

i) a second ram block comprising a V-shaped cutter extension having a second blade extending toward the centerline and disposed in a different plane that the first blade to allow the second blade to pass the first blade during the shearing and contact a sealing element of the blade seal disposed in the first ram afler the shearing;

d. a first actuator coupled to a first ram and adapted to move the first ram toward the centerline; and e. a second actuator coupled to the second ram and adapted to move the second ram toward the centerline, wherein the second retainer further comprises a V-shaped retainer blade surface disposed at a different plane than the first arcuate surface of the second retainer.

9. A system for shearing an oil field tubular product, comprising:

a. a blowout preventer body having an opening disposed therethrough for the tubular product;

b. a first ram coupled to the blowout preventer body along a first guideway formed in the body having a guide surface for the first ram disposed at an angle to a centerline of the opening, comprising:

i. a blade seal comprising:

a) a first retainer with a first arcuate surface having a first radius and a centerpoint for the radius;

b) a sealing element coupled to the first retainer;

ii. a first ram block comprising:

a) a V-shaped cutter extension having a first blade extending toward the centerline; and b) the ram block having a blade seal support disposed in a recessed portion of the block away from the centerline relative to the cutter extension and adapted to support the blade seal, the blade seal support having a first arcuate retainer stop, the first arcuate retainer stop having a radius with a centerpoint common to the first arcuate surface centerpoint of the first retainer and adapted to allow engagement with the blade seal;

c. a second ram coupled to the blowout preventer body along a second guideway formed in the body having a guide surface for the second ram disposed at an angle to a centerline of the opening, comprising:

i) a second ram block comprising a V-shaped cutter extension having a second blade extending toward the centerline and disposed in a different plane that the first blade to allow the second blade to pass the first blade during the shearing and contact a sealing element of the blade seal disposed in the first ram afler the shearing;

d. a first actuator coupled to a first ram and adapted to move the first ram toward the centerline; and e. a second actuator coupled to the second ram and adapted to move the second ram toward the centerline, wherein the first ram block further comprises a bending extension with the recessed portion disposed between the bending extension and the cutter extension.

10. The system of claim 9, further comprising at least one pair of side seals coupled to one or more of the ram blocks.

11. The system of claim 9, further comprising at least one lateral seal disposed on a downstream pressure side of the ram block.

12. A shearing ram for shearing a portion of a tubular member, comprising:

a. a blade seal comprising:

i) a first retainer having a first arcuate surface with a first centerpoint;

ii) a sealing element coupled to the first retainer;

b. a ram block comprising:

i) a cutter extension extending toward the tubular member when the tubular member is placed in position for shearing and adapted to shear the tubular member upon actuation of the ram; and ii) the ram block further having a blade seal support disposed in a recessed portion of the ram block distal from the cutter extension relative to the tubular member placement position and adapted to support the blade seal, the blade seal support having a first arcuate retainer stop having a common centerpoint with the first arcuate surface centerpoint of the first retainer on the blade seal and adapted to allow arcuate engagement with the blade seal, wherein the blade seal support of the ram block further comprises a second arcuate retainer stop having a common centerpoint with the first arcuate retains stop and adapted to allow engagement of at least a portion of the blade seal between the first and second retainer stops.

13. The shearing ram of claim 12, wherein the blade seal comprises a sealing element arcuate surface disposed away from the tubular member placement position relative to the first retainer and adapted to seal against the second arcuate retainer stop of the blade seal support.

14. The shearing ram of claim 13, wherein the first retainer comprises a second arcuate surface disposed away from the tubular member placement position relative to the first arcuate surface with a centerpoint common to the first arcuate surface, the sealing element being adapted to engage the second arcuate surface.

15. A shearing ram for shearing a portion of a tubular member, comprising:

a. a blade seal comprising:

i) a first retainer having a first arcuate surface with a first centerpoint;

ii) a sealing element coupled to the first retainer;

b. a ram block comprising:

i) a cutter extension extending toward the tubular member when the tubular member is placed in position for shearing and adapted to shear the tubular member upon actuation of the ram; and ii) the ram block fUrther having a blade seal support disposed in a recessed portion of the ram block distal from the cutter extension relative to the tubular member placement position and adapted to support the blade seal, the blade seal support having a first arcuate retainer stop having a common centerpoint with the first arcuate surface centerpoint of the first retainer on the blade seal and adapted to allow arcuate engagement with the blade seal, wherein the blade seal comprises a second retainer having a first arcuate surface with a centerpoint common to the first arcuate surface of the first retainer and the sealing element being at least partially coupled between the first and second retainers.

16. The shearing ram of claim 15, wherein the blade seal support comprises a third arcuate retainer stop disposed toward the tubular member placement position relative to the blade seal and adapted to support the second retainer of the blade seal in a direction toward the tubular member placement position.

17. The shearing ram of claim 15, wherein the second retainer further comprises a V-shaped retainer blade surface disposed at a different plane than the first arcuate surface of the second retainer.

18. A shearing ram for shearing a portion of a tubular member, comprising:

a. a blade seal comprising:

i) a first retainer having a first arcuate surface with a first centerpoint;

ii) a sealing element coupled to the first retainer;

b. a ram block comprising:

i) a cutter extension extending toward the tubular member when the tubular member is placed in position for shearing and adapted to shear the tubular member upon actuation of the ram; and ii) the ram block further having a blade seal support disposed in a recessed portion of the ram block distal from the cutter extension relative to the tubular member placement position and adapted to support the blade seal, the blade seal support having a first arcuate retainer stop having a common centerpoint with the first arcuate surface centerpoint of the first retainer on the blade seal and adapted to allow arcuate engagement with the blade seal, wherein the first retainer further comprises a V-shaped retainer blade surface disposed at a different plane than the first arcuate surface.

19. The shearing ram of claim 18, further comprising at least one pair of side seals coupled to the ram block.

20. The shearing ram of claim 18, further comprising at least one lateral seal disposed on a downstream pressure side of the ram block when a tubular member having pressure therein is placed in position for shearing.

* * * * *